US008029325B2

(12) United States Patent
Bardet

(10) Patent No.: US 8,029,325 B2
(45) Date of Patent: Oct. 4, 2011

(54) CONNECTION UNIT AND MOUNTING PROCESS FOR SUCH A CONNECTION UNIT

(75) Inventor: Laurent Bardet, Le Mans (FR)

(73) Assignee: Souriau, Versailles (FR)

( * ) Notice: Subject to any disclaimer, the term of this patent is extended or adjusted under 35 U.S.C. 154(b) by 12 days.

(21) Appl. No.: 12/503,509

(22) Filed: Jul. 15, 2009

(65) Prior Publication Data

US 2010/0029137 A1 Feb. 4, 2010

(30) Foreign Application Priority Data

Jul. 15, 2008 (FR) ..... 08 54807

(51) Int. Cl.
*H01R 13/514* (2006.01)

(52) U.S. Cl. ..... 439/752; 439/701; 439/660; 439/730

(58) Field of Classification Search ..... 439/701, 439/594–599, 730–752.5
See application file for complete search history.

(56) References Cited

U.S. PATENT DOCUMENTS 4,443,048 A * 4/1984 Moist, Jr. ..... 439/599
4,544,220 A * 10/1985 Aiello et al. ..... 439/594
5,569,046 A 10/1996 Pfetzer
5,643,016 A * 7/1997 Huss, Jr. ..... 439/744
5,655,525 A * 8/1997 Orr ..... 128/205.25
6,386,913 B1 * 5/2002 Mohammad et al. ..... 439/579
6,746,284 B1 6/2004 Spink, Jr.
7,351,102 B2 * 4/2008 Cykon et al. ..... 439/587

FOREIGN PATENT DOCUMENTS

EP 0382989 A1 8/1990
EP 1193812 A1 4/2002
EP 1429423 A2 6/2004
EP 1538717 A1 6/2005
FR 2745122 A1 8/1997

* cited by examiner

*Primary Examiner* — Truc Nguyen
(74) *Attorney, Agent, or Firm* — Im IP Law PLLC; C. Andrew Im

(57) ABSTRACT

The invention relates a connection unit comprising an insert provided a front part and a back part provided with longitudinal through holes. At least one longitudinal through hole in the front part of the insert coincides with a longitudinal through hole in the back part. The connection unit includes at least one contact extending through a longitudinal through hole in the front part and through a longitudinal through hole in the back part of the insert. A front portion of the contact is provided with a stop pressing on a stop in the longitudinal hole in the front part of the insert. A back portion of said contact is provided with retaining means which require said back portion be forced into the longitudinal hole in the back part of the insert. The invention also relates a mounting process of such a connection unit, as well as a connection kit.

10 Claims, 3 Drawing Sheets

CONNECTION UNIT AND MOUNTING PROCESS FOR SUCH A CONNECTION UNIT

RELATED APPLICATIONS

This application claims priority from French Patent Application No. 08 54807 filed Jul. 15, 2008, which is herein incorporated by reference in its entirety.

TECHNICAL FIELD OF THE INVENTION

The invention relates to an electric connection unit comprising an insert formed of two parts, a front part and a back part, respectively, in which the contacts are received. The invention also relates to a mounting process for such a connection unit, as well as a corresponding connection kit.

The invention is implemented in the field of the connector industry and particularly of the aviation industry, notably for printed board connection.

BACKGROUND OF THE INVENTION

Connection units are currently known which are provided with an insert having two parts the front or back part of which is provided with metallic or plastic retaining clips for maintaining electric contacts in said insert. Both parts of the insert are generally stuck together for preventing any separation of the unit and for electrically isolating each electric contact.

The presence of such retaining clips in a two-part insert increases the overall dimension for each contact in the insert and the maximal contact density in a given insert volume is limited. Moreover, the presence of these retaining clips, which are most of the time made of a metallic material, generates electric losses which reduce the voltage behavior of such a connection unit.

Connection units are also known which are provided with a monobloc insert, i.e. in one piece, in which the electric contacts are maintained by forcing them into the insert, and the material flexibility of which enables such a deformation that the so-mounted contacts are blocked therein. The realization of such a connection unit is relatively simple, since the insert is formed of one piece, generally molded, and has only few pieces to be assembled.

Until now, the inserts used are exclusively intended to receive only one sort of contacts, i.e. either contacts which are forced into a monobloc insert or contacts which are maintained by a clip in a two-part insert. When one desires to use at the same time forced-mounting contacts and contacts with a retaining clip, which have various properties and advantages, it is now necessary to use two different connection units each having one type of contacts, which needlessly increases the costs and the overall dimension at the electric connection zone.

OBJECT AND SUMMARY OF THE INVENTION

The invention aims at providing a connection unit which can receive either contacts, which are able to be forced into an insert and for which no retaining clip is necessary, or more fragile contacts or contacts with a more important overall dimension which cannot be forced into said insert.

For this purpose, the invention proposes a connection unit in which the mechanical behavior of both parts of the insert, or insulator, is guaranteed by the presence of contacts forced into the insert. Thus, the insert parts are interlocked by the assembly of these contacts. The overall dimension around these contacts is not increased by any retaining device, such as retaining clips, so that it is advantageously possible to increase the contact density for a given insert volume compared to an insert of the state of the art with the same volume.

The invention also proposes forced-mounting contacts, which are provided with a back portion to be received in the back part of the insert, and a front portion to be received in the front part of the insert. The back portion of these contacts has such a retaining system that said back portion must be forced into the back part of the insert and, once it is forced therein, it is impossible, or at least very difficult, to remove it. The material of the back part is advantageously a flexible material able to be deformed in order to enable the introduction of the back part of the contact and to block it once it is introduced. The front part of the forced-mounting contact is provided with stop means which are intended to press on a mechanical stop in the front part of said insert and which form a limit stop preventing the contact from going further into the front part of the insert.

Thus, when a forced-mounting contact is received in the insert, both parts of the insert are maintained together in position because of the presence of this contact. The contact is forced into the back part of the insert in an almost irreversible manner, whereas the front part of said insert cannot be removed because, once the contact is mounted in the insert, the mechanical stop prevents at the same time the contact from going further into the front part of the insert and the front part of the insert from going out of the back part. The contact assembly enables to mechanically maintain the front part and the back part together.

The assembly of the forced-mounting contact into the insert of the connection unit according to the invention, such as the mutual positioning of both insert parts, can be advantageously automated.

The two-part insert enables to obtain a connection unit according to the invention with forced-mounting contacts and contacts with a retaining clip between both parts the insert, which are called here-below clip contacts. The retaining clips, mounted between the front part and the back part of the insert, are placed only at contact channels which are specifically intended to receive this kind of contacts so that the overall dimension, due to these contacts, is reduced to the bare minimum.

Preferably, the contacts used can be welded on a printed board. Of course, any other kind of contacts can be used.

Thus, the object of the invention is a connection unit comprising an insert with two parts, a front part and a back part, respectively, said insert parts being placed one against the other and each insert part being provided with longitudinal through holes realized so that at least one longitudinal through hole in the front part of the insert coincides with a longitudinal through hole in the back part of the insert, the connection unit also including contacts, at least one contact extending through a longitudinal through hole in the front part and through a longitudinal through hole in the back part, characterized in that at least one contact is forced into a hole, said force-mounted contact including a front portion provided with a stop pressing on a stop in the longitudinal hole in the front part of the insert, and in that a back portion of said force-mounted contact is provided with retaining means so that said back portion is forced into a coincident longitudinal hole in the back part of the insert.

The term used "front" refers to the part or the involved element of the connection unit that faces a complementary connector, whereas the term "back" refers to the part or the involved element of the connection unit that faces the electric device to be connected to said complementary connector.

Advantageously, the front and back parts are placed one against the other, eventually in a partial manner, between the back side of the front part of the insert and the front side of the back part of the insert.

Advantageously, the insert has a rectangular form but, if necessary, it can also have a different form, notably a circular form.

The term "longitudinal through hole" refers to a hole, or a channel, which extends right through the involved insert part, i.e. from its back side to its front side, the hole opening thus on each of the sides of the insert part. All the longitudinal holes in the insert, intended to receive contacts, are through holes.

Both insert parts are placed one against the other so that at least one hole in the front part opens into a hole in the back part of the insert. In this way, a contact extending through the hole in the front part of the insert also extends through the coincident hole in the back part of said insert. The alignment of the holes in the front part and in the back part of the insert allows the contact to longitudinally extend right through the insert.

The stop on the front portion of the forced-mounting contact can be formed by a ring or a flange added on the outer diameter of said contact, or directly molded or machined on said contact. The stop can be otherwise formed by reducing the diameter of the forced-mounting contact, the diameter of the portion of the forced-mounting contact before the stop being strictly superior to the diameter of the portion of the forced-mounting contact after said stop.

The stop in the longitudinal hole in the front part of the insert can be notably formed by the internal wall of said hole at a reduction of the diameter of the hole which coincides with the reduction of the diameter of the contact. The stop can be otherwise formed by a piece added or molded in said hole.

The retaining means on the back portion of the forced-mounting contact are formed for example by retaining wings added or directly molded or machined on said forced-mounting contact in such a way that they form a harpoon which prevents said forced-mounting contact from being removed out of the hole, which would otherwise damage the connection unit. The forced introduction of the back portion of the contact into the back portion of the insert enables to maintain not only said forced-mounting contact in position in its hole but also the front part of the insert relatively to the back part of said insert because of the cooperation between the stop of the forced-mounting contact and the stop in the hole in the front part of the insert.

The connection unit according to the invention can also include at least one clip contact, maintained in a longitudinal hole in the front part of the insert and in a coincident longitudinal hole in the back part of said insert by means of a retaining clip, said retaining clip being integral with one of the two parts of the insert.

The term "clip contact" refers to a contact the size or fragility of which prevents it from being forced into the insert, and which must be then maintained in said insert by means of a retaining clip. The retaining clip is placed in the longitudinal hole either in the front part or in the back part of the insert intended to receive it.

Thus, the connection unit according to the invention can have two different kinds of contacts, namely forced-mounting contacts and clip contacts. Only the holes for clip contacts must be provided with a retaining clip so that the overall dimension linked to the presence of such retaining clips is reduced to the bare minimum. Preferably, retaining clips are made of a plastic material and are specifically added into holes needing it according to the use of the connection unit.

Advantageously, the front and back parts of the insert are provided with interlocking means able to center said parts one to another in such a way that at least one longitudinal hole in the front part of the insert coincides with a longitudinal hole in the back part of the insert.

The interlocking means can be notably provided with at least one chimney portion protruding from a back side of the front part of the insert, the chimney portion or protuberance bordering at least partially an open end of a longitudinal hole on said back side and at least one complementary countersunk portion or recess on the front side of the back part of the insert, said countersunk portion bordering at least partially an open end of a longitudinal hole on said front side.

Thus, the chimney portion and the countersunk portion interlocks and the involved holes in the respective parts of the insert extend then in the prolongation one of the other. A good mutual positioning of the front and back parts of the insert is thus guaranteed before introducing the contacts into the holes in the insert, said contacts enabling afterwards to maintain the good mutual position of both parts of the insert.

In a preferred embodiment of the invention, the contacts are pin contacts intended to be welded on a printed board, and notably female pin contacts.

Advantageously, the connection unit can be provided with contacts of different diameters according to the user's need.

Preferably, each longitudinal through hole in the front part of the insert coincides with a longitudinal through hole in the back part of the insert, so that each longitudinal through hole can receive a contact.

The invention also relates a mounting process for a connection unit according to the invention, characterized in that it comprises the following steps:

the front part is moved onto the back part of said insert, so that the back side of the front part of the insert is at least partially placed against the front side of the back part of said insert;

a back end of a first forced-mounting contact is introduced into a longitudinal hole in the front part of the insert;

the first forced-mounting contact is introduced further until it enters a coincident longitudinal hole in the back part of said insert;

the back portion of the first forced-mounting contact is forced into the longitudinal hole in the back part of the insert until the stop of the front portion of said forced-mounting contact abuts on the mechanical stop of the front part of the longitudinal hole.

The same process is used for introducing each forced-mounting contact into the insert.

Once at least one forced-mounting contact is mounted in the insert, a clip contact can be introduced into a longitudinal hole in the front part of the insert and in a coincident longitudinal hole in the back part, one the two holes being provided with a retaining clip able to maintain the clip contact in position in said holes.

In this case, the retaining clip(s) is (are) either molded or mounted in the longitudinal hole(s) in the front part or back part of the insert intended to receive them, before placing both parts of the insert one against the other.

The same process is then used for each clip contact to be introduced into the insert.

Advantageously, the front part of the insert is placed onto the back part of said insert so that complementary interlocking means, respectively on the back side of the front part of the insert and on the front side of the back part of said insert, cooperate one with another.

The invention also relates a connection kit, comprising an insert having two parts, respectively a front part and a back part, able to be placed one against the other, each insert part being provided with longitudinal through holes so that at least one longitudinal hole in the front part of the insert can coincide with a longitudinal hole in the back part of the insert when both parts are placed one against the other, at least one forced-mounting contact, including a front portion provided with a stop intended to press on a stop in a longitudinal hole in the front part of the insert, and a back portion provided with retaining means able to enable said back portion of said contact to be forced into a longitudinal hole in the back portion of the insert.

The connection kit can also comprise at least one clip contact, at least one insert part comprising then at one of its longitudinal hole a retaining clip able to maintain such a clip contact in position in said hole.

Advantageously, the front and back parts of the insert are provided with interlocking means, able to center said parts one to another so that at least one longitudinal hole in the front part of the insert can coincide with a longitudinal hole in the back part of the insert.

BRIEF DESCRIPTION OF THE DRAWINGS

The invention will be better understood by reading the following description and the annexed figures. These figures are only indicative and are not intended to limit the invention. In the figures.

DETAILED DESCRIPTION OF THE EMBODIMENTS

Figure 1:
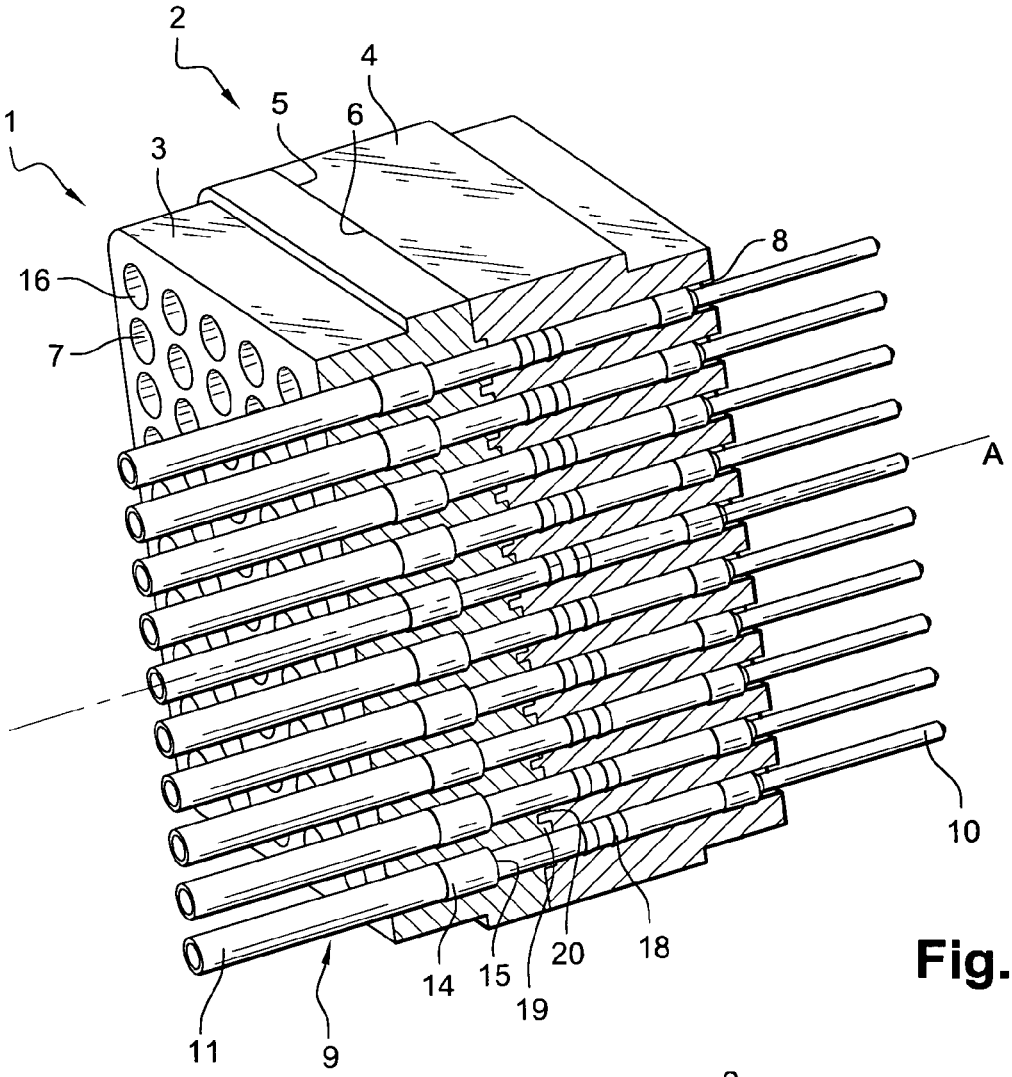
FIG. 1 is a partial perspective representation of a connection unit according to the invention provided with forced-mounting contacts.

The connection unit 1 represented in FIGS. 1, 2, 3 and 4 comprises an insert 2 provided with a front part 3 and a back part 4, arranged one to another so that a back side 5 of the front part is placed against a front side 6 of the back part 4.

In FIGS. 1, 2, 3 and 4, the back elements are on the right side relatively to the front elements placed on the left side.

The described insert 2 is a right parallelepiped composed of two right parallelepipeds forming the front part 3 and the back part 4 the largest sides of which form the front and back sides of each of both parts 3, 4 of the insert 2.

Each insert part is provided with a plurality of longitudinal holes 7, 8 which extend parallel to the longitudinal axe A so that they extend right through said insert 2 and open at each of the front and back sides of the involved insert parts 3, 4.

Each longitudinal through hole 7 in the front part 3 of the insert 2 coincides with a longitudinal through hole 8 in the back part 4 of the insert, so that a forced-mounting contact 9 extending through the insert 2 extends through a longitudinal hole 7 in the front part 3 as well as through a longitudinal hole 8 in the back part 4 of said insert 2.

The forced-mounting contacts 9, represented in the Figs., are female pin contacts, i.e. a back end 10 of said forced-mounting contacts is a pin, intended for example to be welded on a printed board (not represented). The front end 11 of said forced-mounting contacts is provided with a barrel intended to be crimped on a contact of a complementary connector (not represented).

Figure 2:
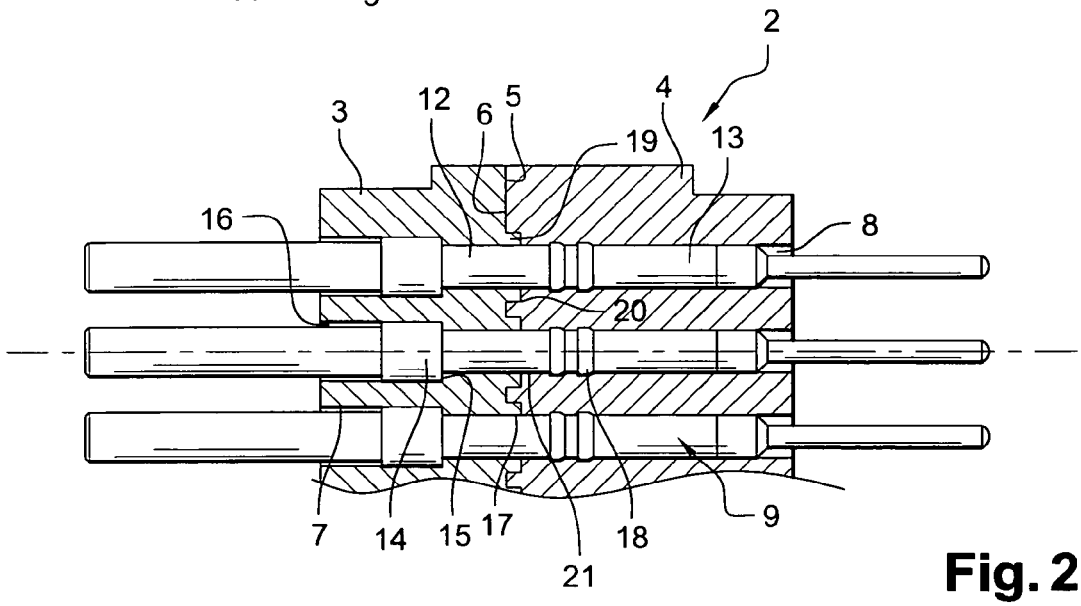
FIG. 2 is a partial cross-section of an insert according to the invention provided with forced-mounting contacts.

As it is more clearly represented in FIG. 2, each forced-mounting contact 9 is provided with a front portion 12 received in a longitudinal hole 7 in the front part 3 of the insert 2, and with a back portion 13 received in a longitudinal hole 8 in the back part 4 of the insert 2.

The front portion 12 of a forced-mounting contact has locally a longer diameter 14; i.e. on both sides of this part with the longer diameter 14, the front part 12 of the forced-mounting contact 9 has a strictly smaller diameter. This part with the longer diameter 14 abuts on a mechanical stop 15 in the corresponding longitudinal hole 7 in the front part 3 of the insert 2. The mechanical stop 15 is formed by a reduction of the diameter of said longitudinal hole 7, said diameter of the longitudinal hole 7 being strictly longer at its front open end 16 than at its back open end 17. Thus, the forced-mounting contact 9 cannot slide further into the longitudinal hole 7, because the mechanical stop 15 prevents said forced-mounting contact 9 from translating beyond said stop 15. In the example represented, the part with the longer diameter 14 is formed by a flange added or molded around the outer diameter of the front part 12 of the forced-mounting contact 9.

Moreover, the back portion 13 of the forced-mounting contact 9 is provided with harpoons 18, or retaining clips, which extend locally on an outer perimeter of said back portion 13 of said forced-mounting contact 9, the diameter of the longitudinal hole 8 in the back part of the insert 2 having such a dimension that the part of said back portion 13 of the forced-mounting contact 9, which portion is provided with harpoons 18, can be introduced into the longitudinal hole 8 only by a forced introduction action.

Thus, once the back portion 13 of said forced-mounting contact 9 is forced into the longitudinal hole 8 in the back part 4 of the insert 2, it is no more possible to remove said forced-mounting contact 9 by chance. It is possible to realize the insert 2 and the forced-mounting contacts 9 in such a way that said forced-mounting contacts 9 can be intentionally disassembled by exerting a traction force for disengaging the harpoons 18 from the longitudinal hole 8. Once the flange 14 abuts on the mechanical stop 15 in the longitudinal hole 7 in the front part 3 of said insert 2, the forced-mounting contact 9 cannot translate further into the longitudinal hole 8 in the back part 4 of the insert 2.

Once the forced-mounting contacts 9 are placed in both successive parts 3, 4 of the insert 2, said parts 3, 4 of the insert 2, placed one against the other, are maintained together.

Moreover, as it is represented in the figures, it is possible to provide the back side 5 of the front part 3 of the insert 2 as well as the front side 6 of the back part 4 of said insert 2 with a polarization system allowing to ensure a good alignment of the longitudinal holes 7, 8 so that each of the longitudinal holes 7 in the front part 3 of the insert 2 coincides with a longitudinal hole 8 in the back 4 of the insert 2.

This polarization system is formed, for example, of interlocking means comprising chimney portions 19 protruding from the back side 5 of the front part 3 of the insert 2, and countersunk portions 20 on the front side 6 of the back part 4 of the insert 2, the dimensions of which enable the reception of the chimney portions 19. Each of the chimney portions 19 borders a back open end 17 of a longitudinal hole 7, whereas each countersunk portion 20 borders a front open end 21 of a longitudinal hole 8.

Thus, a good mutual positioning of the parts 3, 4 of the insert 2 is guaranteed just before the reception of the forced-mounting contacts 9 by the corresponding holes 7, 8.

Of course, it is possible to realize interlocking means 19, 20 only at some longitudinal holes 7, 8, for example only at holes placed at the four corners of the rectangular insert 2.

Of course, any other polarization system for a good mutual positioning of both parts 3, 4 of the insert 2 can be used.

Figure 3:
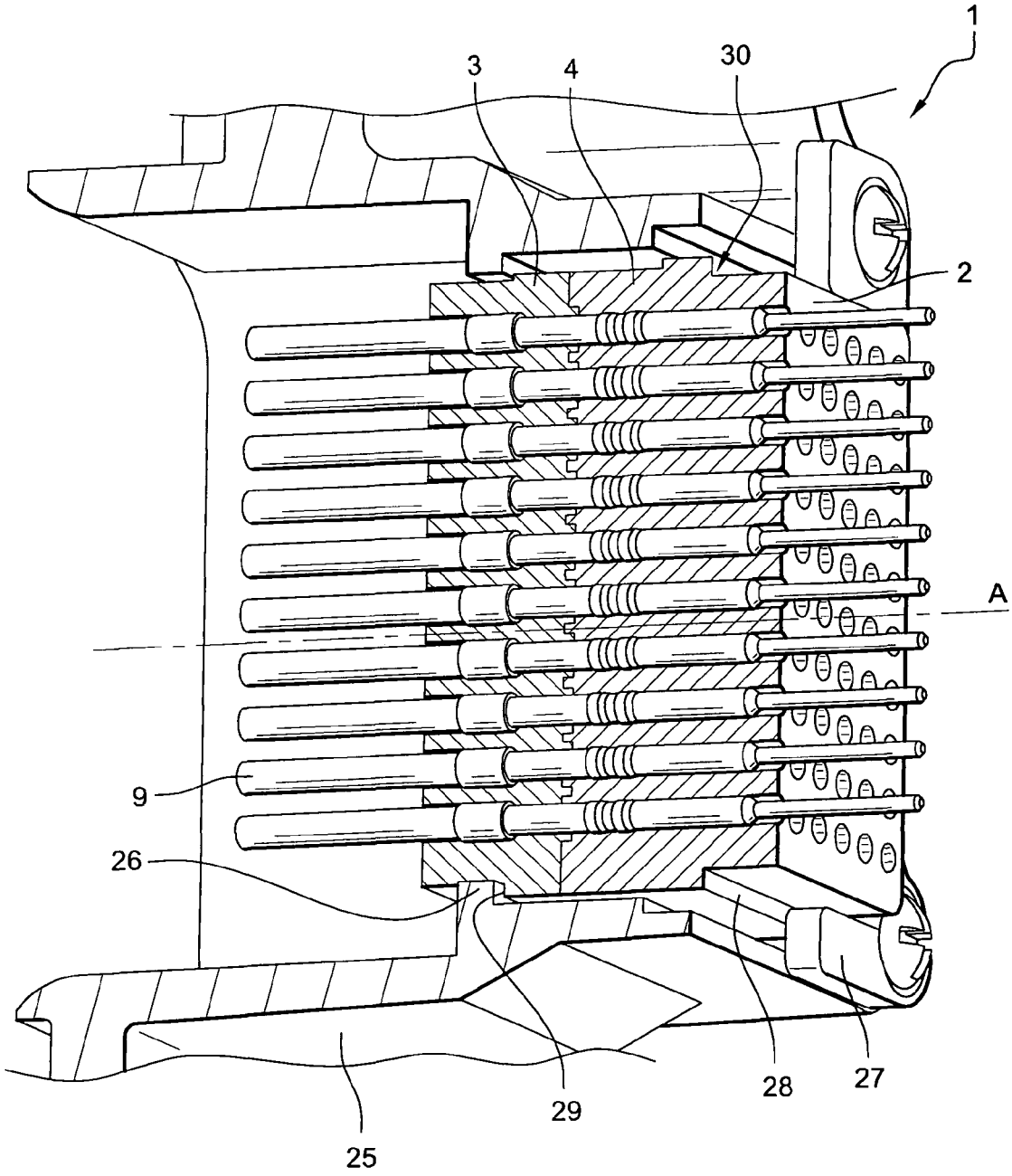
FIG. 3 represents the connection unit of FIG. 1 received in a connection box.

Advantageously, as it is represented in FIG. 3, the connection unit is mounted in a connection box 25, which is classically provided with small retaining bars 26, 27 cooperating with stops 28, 29 on external lateral walls 30 of said front part 3 and back part 4 of the insert 2. These small retaining bars 26, 27 and stops 28, 29 also contribute maintain the connection unit 1 according to the invention.

For a better visibility and understanding, all the forced-mounting contacts 9 are not represented in FIGS. 1 and 3. Of course, it is possible to provide the insert 2 with more or fewer forced-mounting contacts 9; all the longitudinal holes 7, 8 can have such forced-mounting contacts 9 therethrough.

The mounting of such a connection unit can be realized automatically by a machine. The retaining means on the forced-mounting contacts 9 enable a good maintain and a good mutual positioning of the front part 3 and the back part 4 of the insert 2, as well as a good maintain of the forced-mounting contacts 9 in the insert 2.

Figure 4:
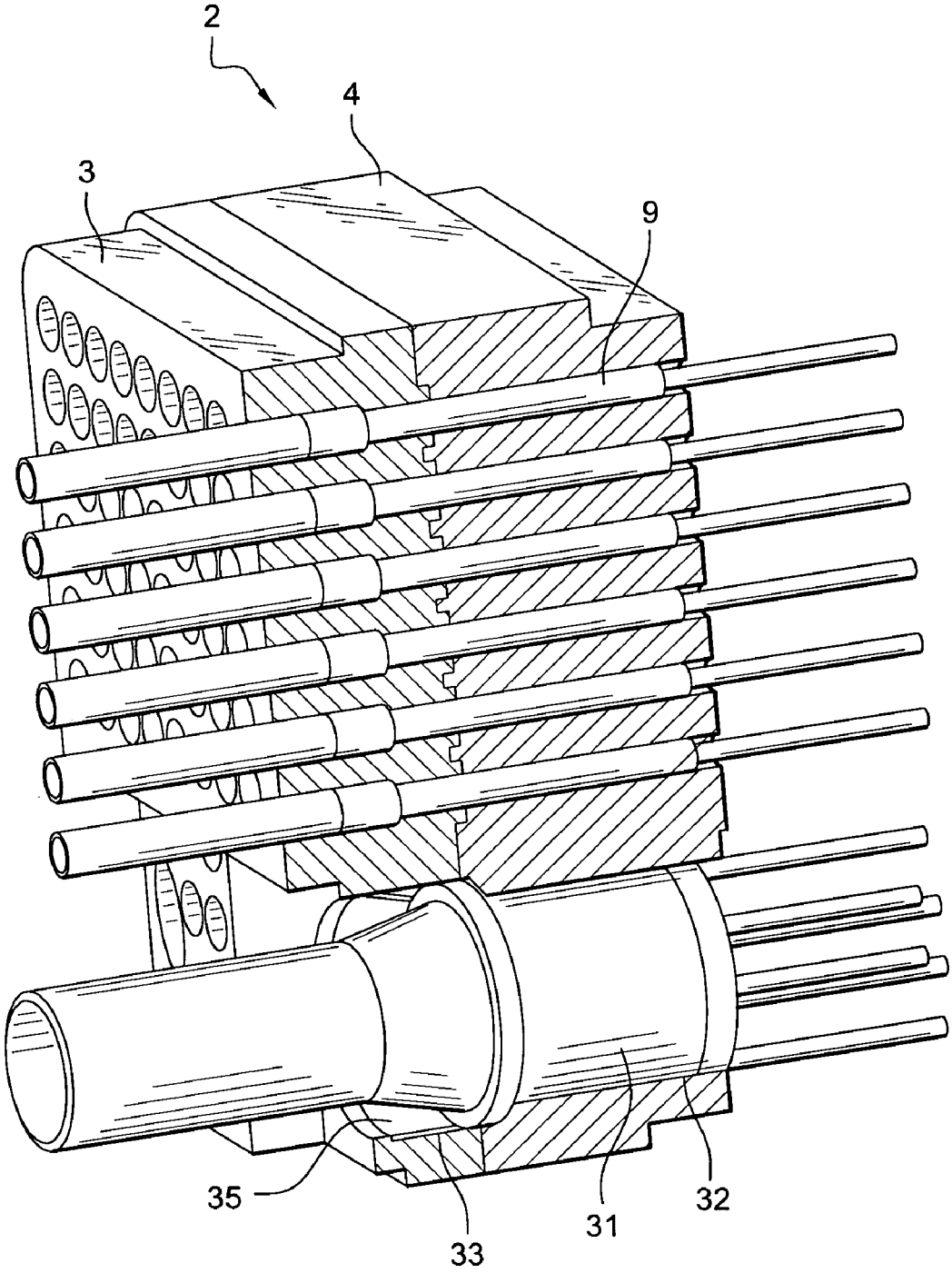
FIG. 4 is a partial perspective representation of a connection unit according to the invention provided with forced-mounting contacts and with a clip contact.

In FIG. 4, besides a plurality of forced-mounting contacts 9, the insert 2 is provided with a clip contact 31 mounted in a specific longitudinal hole 32, 33 longitudinally extending through the insert 2. The overall dimension of the clip contact 31 is highly superior to that of the forced-mounting contacts 9.

Classically, a retaining clip 35 is mounted in the front hole 33 in the front part 3 of the insert 2, so as to be partially received in the coincident back hole 32 when both parts 3, 4 of the insert 2 are placed one against the other.

The retaining clip 35 is maintained in position in the holes 32, 33 by the forced-mounting contacts 9, which maintain both parts 3, 4 of the insert 2 together.

Thus, advantageously, the connection unit 1 according to the invention enables to have contacts 9, 31 in one insert 2, in order to meet the user needs without needlessly increasing the number of inserts and thus to reduce the overall dimension of electrical fittings.

The invention claimed is:

1. A connection unit comprising:

an insert with two parts, a front part and a back part, respectively, said insert parts being placed one against the other and each insert part being provided with longitudinal through holes so that at least one longitudinal through hole in the front part of the insert coincides with a longitudinal through hole in the back part of the insert;

at least one forced-mounting contact extending through said at least one longitudinal through hole in the front part and through a coincident longitudinal through hole in the back part, said at least one forced-mounting contact comprising a front portion with a stop pressing on a mechanical stop in said at least one longitudinal through hole in the front part of the insert and a back portion with a retainer so that said back portion is forced into said coincident longitudinal through hole in the back part of the insert, wherein mechanical behavior of the two parts of the insert is provided by the presence of said at least one forced-mounting contact in the front and back parts of the insert; and at least one clip contact maintained in said at least one longitudinal through hole in the front part of the insert and in said coincident longitudinal through hole in the back part of said insert by a retaining clip, said retaining clip being integral with one of the two parts of the insert.

2. The connection unit of claim 1, wherein the front and back parts of the insert comprise interlocking components for centering the front and back parts of the insert such that said at least one longitudinal through hole in the front part of the insert coincides with a longitudinal through hole in the back part of the insert.

3. The connection unit of claim 2, wherein said interlocking components comprise at least one chimney portion protruding from a back side of the front part of the insert, said at least one chimney portion bordering at least partially an open end of a longitudinal through hole on said back side of the front part of the insert, and at least one complementary countersunk portion on the front side of the back part of the insert, said countersunk portion bordering at least partially an open end of a longitudinal through hole on said front side of the back part of the insert.

4. The connection unit of claim 1, wherein said at least one forced-mounting contact comprises pin contacts to be welded on a printed board.

5. The connection unit of claim 1, wherein each longitudinal through hole in the front part of the insert coincides with a longitudinal through hole in the back part of the insert.

6. A process for mounting a connection unit comprising an insert with two parts, a front part and a back part, respectively, each insert part being provided with longitudinal through holes, and at least one forced-mounting contact comprising a front portion with a stop pressing on a mechanical stop in at least one longitudinal through hole in the front part of the insert and a back portion with a retainer so that said back portion is forced into a coincident longitudinal through hole in the back part of the insert, the process comprising the steps of:

moving the front part of the insert onto the back part of the insert, so that a back side of the front part of the insert is at least partially placed against a front side of the back part of the insert;

introducing a back end of said at least one forced-mounting contact into said at least one longitudinal through hole in the front part of the insert;

introducing said at least one forced-mounting contact further through said coincident longitudinal through hole in the back part of the insert;

forcing the back end of said at least one forced-mounting contact into said coincident longitudinal through hole in the back part of the insert until the stop of the front portion of said at least one forced-mounting contact abuts on the mechanical stop in said at least one longitudinal through hole in the front part of the insert, wherein mechanical behavior of the two parts of the insert is provided by the presence of said at least one forced-mounting contact in the front and back parts of the insert;

introducing at least one clip contact into said at least one longitudinal through hole in the front part of the insert and in said coincident longitudinal through hole in the back part of the insert once at least one forced-mounting contact is mounted in the insert; and maintaining said at least one clip contact in position in said at least one longitudinal through hole in the front part of the insert and in said coincident longitudinal through hole in the back part of the insert by a retaining clip provided either in said at least one longitudinal through hole in the front part of the insert or in said coincident longitudinal through hole in the back part of the insert.

7. The process of claim 6, further comprising the step of introducing each forced-mounting contact in a longitudinal through hole of the front part of the insert and in a corresponding longitudinal through hole of the back part of the insert.

8. The process of claim 6, further comprising the step of centering the front and back parts of the insert by complementary interlocking components on the back side of the front part of the insert and on the front side of the back side of the insert when the front part of the insert is placed onto the back part of the insert.

9. A connection kit, comprising:

an insert having two parts, respectively a front part and a back part, each insert part comprising longitudinal through holes so that at least one longitudinal hole in the front part of the insert coincides with a longitudinal hole in the back part of the insert when two insert parts are placed one against the other;

at least one forced-mounting contact comprising a front portion with a stop to press on a mechanical stop in said at least one longitudinal hole in the front part of the insert, and a back portion with a retainer to force the back portion of said at least one forced-mounting contact into a coincident longitudinal hole in the back part of the insert, wherein mechanical behavior of the two parts of the insert is provided by the presence of said at least one forced-mounting contact in the front and back parts of the insert; and at least one clip contact and a retaining clip at a longitudinal through hole of one of the two insert parts, said retaining clip maintaining said at least one clip contact in said longitudinal through hole of one of the two insert parts.

10. The connection kit of claim 9, wherein the front and back parts of the insert comprise interlocking components for centering the two insert parts such that said at least one longitudinal through hole in the front part of the insert coincides with said coincident longitudinal through hole in the back part of the insert.

* * * * *